US006015061A

United States Patent [19]

Lowry

[11] Patent Number: 6,015,061

[45] Date of Patent: Jan. 18, 2000

[54] DUAL FUNCTION OVERCAP

[75] Inventor: James W. Lowry, Florence, S.C.

[73] Assignee: Sonoco Development, Inc., Hartsville, S.C.

[21] Appl. No.: 09/113,989

[22] Filed: Jul. 10, 1998

[51] Int. Cl.[7] ..... B65D 51/00

[52] U.S. Cl. ..... 220/287; 220/780; 220/796; 220/801; 215/319

[58] Field of Search ..... 220/287, 780, 220/796, 801; 215/319

[56] References Cited

U.S. PATENT DOCUMENTS

| | | | |
|---|---|---|---|
| 893,469 | 7/1908 | Essmuller | 220/287 X |
| 1,979,706 | 11/1934 | Reamy | 220/287 |
| 2,760,672 | 8/1956 | Cronheim . | |
| 3,141,567 | 7/1964 | Schearer . | |
| 3,455,500 | 7/1969 | Wilcox . | |
| 3,606,074 | 9/1971 | Hayes . | |
| 3,624,789 | 11/1971 | Peyser et al. | 220/287 X |
| 4,047,329 | 9/1977 | Holt . | |
| 4,061,244 | 12/1977 | Tucker . | |
| 4,091,953 | 5/1978 | Daenen . | |
| 4,957,039 | 9/1990 | Reyes . | |
| 5,169,020 | 12/1992 | Spamer . | |
| 5,377,859 | 1/1995 | Hacker . | |
| 5,392,949 | 2/1995 | McKenna . | |
| 5,429,265 | 7/1995 | Maire et al. . | |
| 5,497,879 | 3/1996 | Kao . | |
| 5,577,539 | 11/1996 | Shaw et al. . | |
| 5,586,656 | 12/1996 | Abrums . | |
| 5,597,088 | 1/1997 | Fingerle et al. . | |
| 5,678,720 | 10/1997 | Van Melle . | |
| 5,695,086 | 12/1997 | Viola . | |

FOREIGN PATENT DOCUMENTS

| | | | |
|---|---|---|---|
| 2306136 | 10/1976 | France | 220/287 |
| 7420970 | 11/1974 | Germany . | |

*Primary Examiner*—Stephen K. Cronin
*Attorney, Agent, or Firm*—Bullwinkel Partners, Ltd.

[57] ABSTRACT

A dual function overcap for a cylindrical container, having a bead about the top edge and generally used for snack foods, includes a substantially planar covering portion and a downwardly extending lip. The dual function overcap fits over the container with a bead by engaging the downwardly extending lip or can fit a shortened form of the same container without a bead, or the same, or similar, container without a bead. In one form of the invention, the overcap must be flipped over to attach the overcap to the edge of the shortened container. In the preferred form of the invention, a raised channel within the covering portion, receives and retains the edge of the shortened container.

4 Claims, 2 Drawing Sheets

DUAL FUNCTION OVERCAP

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to caps or covers for containers, and more particularly to a cap that can fit a container with or without a bead around the top edge of the container.

2. Description of the Related Art

A disadvantage of storing snack foods (chips, cookies, etc.) in tall narrow cylindrical containers is that it becomes increasingly difficult to reach the food as the supply is diminished. A possible solution to this problem is to create a sectioned container, i.e. one in which sections can be removed as the food is eaten, resulting in a shorter container.

A problem with sectioned containers is that the container still must be closed after a section is removed. In typical snack food containers, the container is beaded over at the top, sealed with a membrane, then covered with an overcap that fits over the bead. If the top section of the container is removed, the bead is removed with it, making it difficult to seal the shortened container with the same overcap since the overcap does not fit as well over the shortened container.

A variety of caps or covers which are designed to accommodate different sized containers are known in the art. Among these are those disclosed in Cronheim U.S. Pat. No. 2,760,672; Schearer U.S. Pat. No. 3,141,567; Hayes U.S. Pat. No. 3,606,074; Spamer U.S. Pat. No. 5,169,020; Hacker U.S. Pat. No.5,377,859; Van Melle U.S. Pat. No. 5,678,720; Viola U.S. Pat. No. 5,695,086. However, none of these caps will work for a container with a bead, and also for the same, or a similar, container or the same container in a shortened form, without a bead.

Therefore, a need exists for a cap or cover that is dual function, i.e., that can fit a container with a bead and also the same, or a similar, container or the same container in a shortened form, without a bead. The present invention is designed to fill this need.

BRIEF SUMMARY OF THE INVENTION

The present invention is a dual function overcap comprising a substantially planar covering portion, a downwardly extending lip circumferentially disposed about the covering portion, the lip configured to receive and retain a bead around the top edge of a container, and means for attaching the overcap to the edge of the same container in a shortened form, or to the top edge of the same, or a similar, container, without the bead. The dual function is the overcap's capability of fitting both a container with a bead and the same container in a shortened form without a bead.

In one embodiment of the invention, the means for attaching the overcap to the edge of the shortened container comprises a raised preferably circular ledge disposed in the upper surface of the covering portion and configured so that, when the overcap is flipped over, the overcap rests on the edge of the shortened container and the ledge fits snugly by a friction fit inside the shortened container. In a second, preferred embodiment of the invention, the means for attaching the overcap to the edge of the shortened container comprises a narrow raised channel disposed in the upper surface of the covering portion, the channel configured to receive and retain the edge of the shortened container. The channel has a tapered side to guide the overcap onto the edge of the shortened container.

Thus, it is a principal object of this invention to provide a dual function overcap that fits over not only the container bead, but also the same container in a shortened form without the bead.

Another object of the invention is to provide a dual function overcap that fits over a container with a bead around the top edge, and also over the same, or a similar, container without the bead.

DETAILED DESCRIPTION OF THE INVENTION

Figure 1:
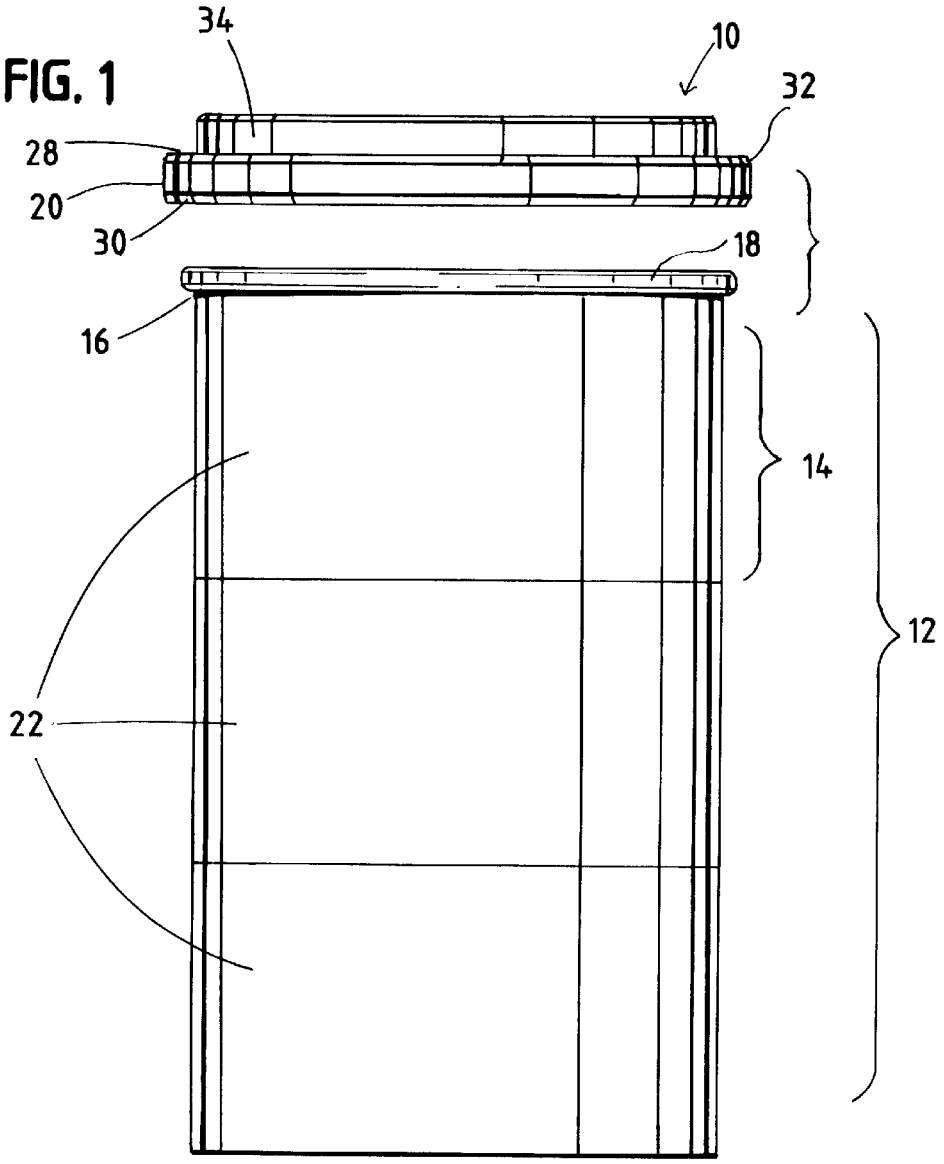
FIG. 1 is a side view of one embodiment of the overcap according to the present invention and a container with a bead.

Turning to the drawings, there is shown in FIGS. 1–5 two embodiments of a dual function overcap 10, 110 for providing a snug fit over a container 12. The container 12 is cylindrical in shape and has a top 14, a top edge 16, and a bead 18 peripherally disposed about the top edge 16. The bead 18 is a substantially circular ring made of paper, plastic, metal or some other appropriate material.

The overcap 10 or 110 according to the present invention is preferably substantially circular. However, since containers and their corresponding beads may be other shapes, including, but not limited to, square or triangle, or any other geometric shape, it is contemplated that the shape of the overcap could be any shape required to fit the shape of the corresponding container.

Figure 2:
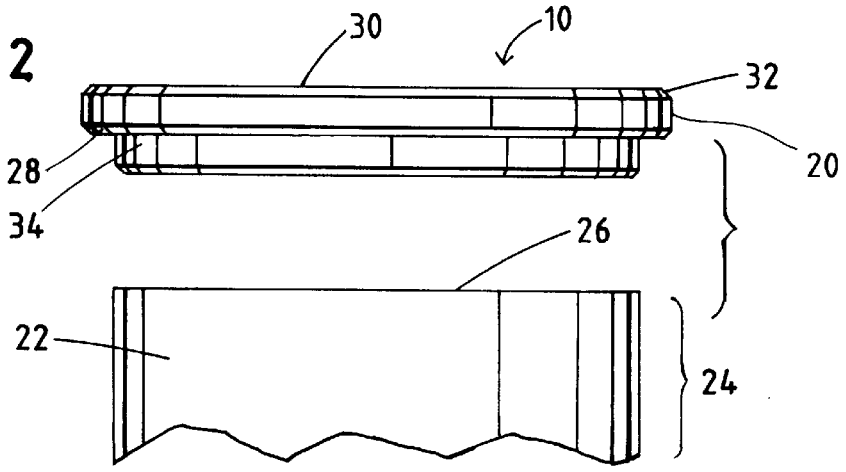
FIG. 2 is a side view of the same embodiment as FIG. 1 showing the overcap in the flipped over position and a shortened container without a bead.

As shown in FIG. 1, the container 12 may be comprised of more than one cylindrical subsection 22. The subsections 22 can be stacked one upon the other. The top 14 is the uppermost of the subsections 22 and is the only one of the subsections 22 having a bead 18. The top 14, having the bead 18 about the top edge 16, may be removed with or without any one or more of the subsections 22 from the other subsections 22 to form a shortened container 24. As best shown in FIG. 2, the shortened container 24 has an edge 26 but no bead.

In one embodiment shown in FIGS. 1 and 2, the dual function overcap 10 is comprised of a substantially planar covering portion 20, a first means for attaching the overcap 10 to the bead 18 and a second means for attaching the overcap 10 to the edge 26 of the shortened container 24, or to the top edge 16 of the container 12 without a bead. The substantially planar covering portion 20 has an upper surface 28 and an under surface 30.

As shown in FIG. 1, the first means for attaching the overcap 10 to the bead 18 may be a conventional downwardly extending lip 32 circumferentially disposed about the covering portion 20. As is known in the art, the lip 32 is configured to receive and retain the bead 18 so as to provide a snug fit for the overcap 10 to the container 12. The second means for attaching the overcap 10 to the edge 26 of the shortened container 24 is a raised ledge 34 disposed in the upper surface 28 of the covering portion 20.

In this first embodiment of the invention, in order to engage the ledge 34 to attach the overcap 10 to the shortened container 24, or to the container 12 without the bead 18, the overcap 10 must be flipped over. The ledge 34 is preferably a solid lifted ring extruded from the upper surface 28 of the covering portion 20, but may be any shape appropriate to conform to the shape of the shortened container 24, or the container 12 without the bead.

The outer diameter of the ledge 34 is just large enough to provide a snug fit of the ledge 34 within the shortened container 24. When the overcap 10 is in the flipped over position and placed on top of the shortened container 24, the ledge 34 provides outward pressure to the inside wall of the shortened container 24 causing a friction fit within the shortened container 24.

Thus, the ledge 34 is configured so that when the overcap 10 is flipped over and placed on top of the shortened container 24, the upper surface 28 faces in a downward direction, the overcap 10 rests on the edge 26 of the shortened container 24, and the ledge 34 fits snugly inside the shortened container 24. The friction fit of the ledge 34 inside the shortened container 24 prevents infestation and debris from getting inside the shortened container 24 and also prevents the product inside the shortened container 24 from spilling out.

Figure 3:
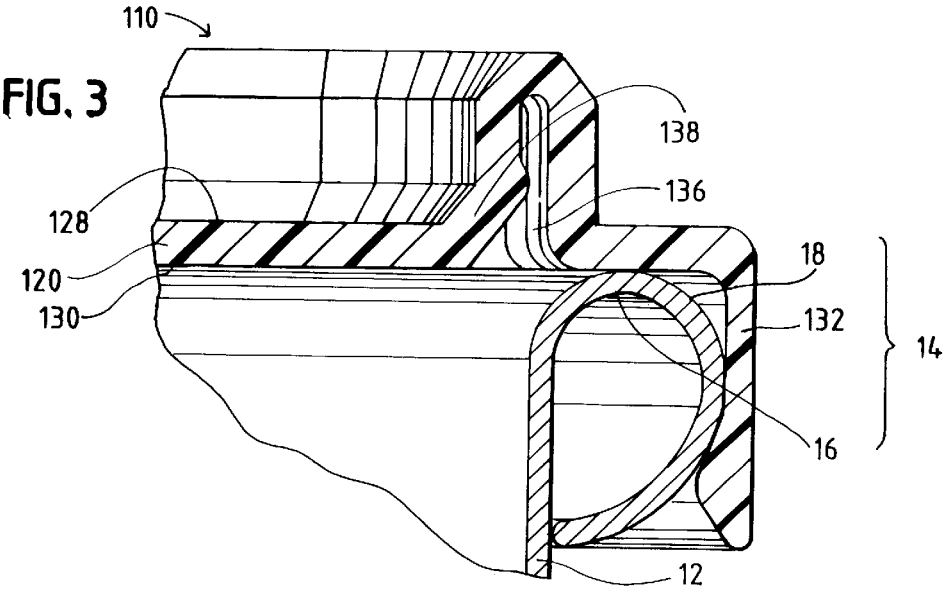
FIG. 3 is a cross-sectional view of a second embodiment of the overcap according to the present invention attached to a container having a bead.
Figure 4:
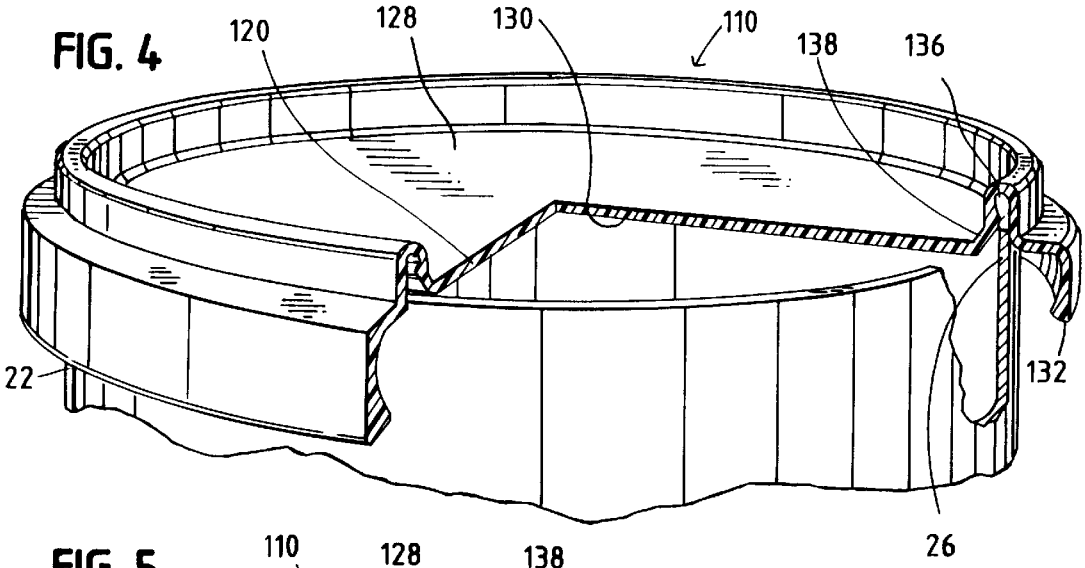
FIG. 4 is a perspective partial cutaway view of the overcap of FIG. 3 attached to a shortened container without a bead.
Figure 5:
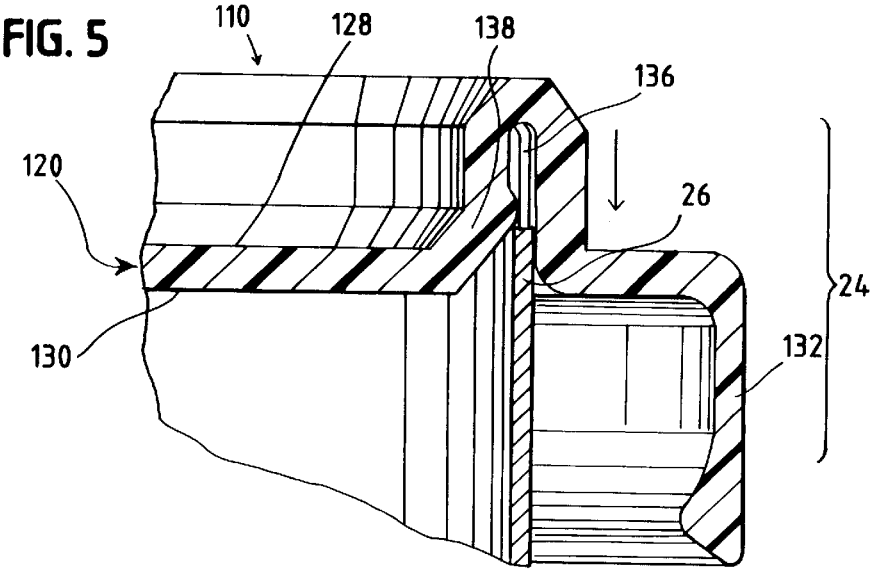
FIG. 5 is a cross-sectional view of the overcap of FIG. 3 attached to a shortened container without a bead.

In a second, preferred embodiment shown in FIGS. 3–5, the dual function overcap 110 is comprised of a substantially planar covering portion 120, a first means for attaching the overcap 110 to the bead 18 and a second means for attaching the overcap 110 to the edge 26 of the shortened container 24, or to the top edge 16 of the container 12 without the bead 18. The substantially planar covering portion 120 has an upper surface 128 and an under surface 130. As shown in FIG. 3, the first means for attaching the overcap 110 to the bead 18 may be a conventional downwardly extending lip 132 circumferentially disposed about the covering portion 120. As is known in the art, the lip 132 is configured to receive and retain the bead 18 so as to provide a snug fit for the overcap 110 to the container 12.

As shown in FIGS. 4 and 5, in this preferred embodiment of the invention, the second means for attaching the overcap 110 to the to the edge 26 of the shortened container 24, or to the top edge 16 of the container 12, is a narrow raised channel 136. The channel 136 is disposed in the upper surface 128 of the covering portion 120 of the overcap 110. The edge 26 of the shortened container 24 force fits into the channel 136. The channel 136 is configured to receive and retain the edge 26 of the shortened container 24, or the top edge 16 of the container 12, without the bead. The inside of the channel 136 has a tapered side 138 which serves to guide the overcap 110 onto the edge 26 of the shortened container 24.

The width of the channel 136 is proportional to the width of edge 26 of the shortened container so as to provide an easy and snug fit of the overcap 110 to the shortened container 24. The channel 136 can be V-shaped, U-shaped, square shaped or any other shape as long as the width of the channel is large enough to receive, retain and secure the edge 26 of the shortened container 24.

Other embodiments of the invention are contemplated which do not depart from the scope of the invention claimed. While the preferred form of the invention has been shown and described herein, it is to be understood that the invention is not to be taken as limited to the specific form described herein, and that changes and modifications may be made without departing from the true concept of the invention. It is therefore contemplated that the foregoing teachings and the appended claims define the present invention and any and all changes and modifications.

I claim as my invention:

1. A dual function overcap for use with a beaded container having a plurality of separable sections which can be separated to reduce the height of the container, said overcap comprising:

a substantially planar covering portion;

a raised annular member circumferentially disposed about the covering portion and having an inner wall and an outer wall joined at an apex and defining a channel therebetween, said channel having a single finite diameter and configured to receive and retain a shortened container edge; and a lip extending downwardly from the outer wall of the raised annular member and configured to receive and retain a bead.

2. The overcap of claim 1 wherein the lip extends below the plane of the covering portion.

3. The overcap of claim 1 wherein the lip has a concave interior surface to retain the bead with a snap fit.

4. A dual function overcap for use with a beaded container having a plurality of separable sections which can be separated to provide a shortened container without a bead, said overcap comprising:

a substantially planar covering portion;

a downwardly extending lip circumferentially disposed about the covering portion and configured to receive and retain a bead; and an annular ring extending upwardly from the covering portion such that, when the overcap is inverted and placed on top of a shortened container, the annular ring engages the shortened container.

* * * * *